United States Patent [19]

Matsumura et al.

[11] Patent Number: 4,714,543

[45] Date of Patent: Dec. 22, 1987

[54] METHOD OF TREATING BROWN COAL FOR LIQUEFACTION

[75] Inventors: Tetsuo Matsumura; Toshio Ohzawa; Akihiro Kawashima; Osamu Ohkuma; Saburo Sawada; Shun'ichi Yanai; Hiroshi Yoshimura; Yasuo Sugino, all of Kobe, Japan

[73] Assignees: Kabushiki Kaisha Kobe Seiko Sho, Kobe; Idemitsukosan Kabushiki Kaisha, Tokyo; Mitsubishikaseikogyo Kabushiki Kaisha, Tokyo; Aziasekiyu Kabushiki Kaisha, Tokyo, all of Japan

[21] Appl. No.: 825,990

[22] Filed: Feb. 4, 1986

Related U.S. Application Data

[63] Continuation of Ser. No. 548,852, Apr. 10, 1983, abandoned.

[51] Int. Cl.[4] ..... C10G 1/00; C10G 1/06

[52] U.S. Cl. ..... 208/412; 208/413; 208/418; 208/425

[58] Field of Search ..... 208/8 LE, 10, 412, 413, 208/418, 425

[56] References Cited

U.S. PATENT DOCUMENTS

| | | | |
|---|---|---|---|
| 4,128,471 | 12/1978 | Malone et al. | 208/8 |
| 4,185,395 | 1/1980 | Nakako et al. | 34/12 |
| 4,206,033 | 6/1980 | Neavel et al. | 208/8 LE |
| 4,235,699 | 11/1980 | Ratcliffe et al. | 208/8 LE |
| 4,322,283 | 3/1982 | Maa et al. | 208/8 R |
| 4,443,321 | 4/1984 | Compton | 208/8 LE |

*Primary Examiner*—Andrew H. Metz
*Assistant Examiner*—William G. Wright
*Attorney, Agent, or Firm*—Oblon, Fisher, Spivak, McClelland & Maier

[57] ABSTRACT

A starting slurry composed of raw brown coal and a solvent is heated and pressurized, subjected to gas-liquid separation and dehydration and then to hydrogenation/liquefaction. The $CO_2$-containing gas produced in the preheating/dehydration step and/or a $CO_2$-containing gas supplied from outside the system is blown into the slurry in the above-mentioned preheating/dehydration step, whereby carbonate-forming metal components in the brown coal are converted to the carbonates thereof in advance. In this manner, the hydrogenation/liquefaction efficiency is improved, and stabilized long-term continuous operation is attained.

3 Claims, 4 Drawing Figures

METHOD OF TREATING BROWN COAL FOR LIQUEFACTION

This is a continuation of application Ser. No. 548,852, filed Apr. 10, 1983, now abandoned.

BACKGROUND OF THE INVENTION

Field of the Invention

This invention relates to a method of treating brown coal for liquefaction and more particularly to an improvement in the preliminary treatment step of the brown coal liquefaction system, which improvement consists in efficiently removing moisture in raw brown coal and at the same time preventing the adhesion and accumulation of carbonates formed in the step of dehydration and/or of precipitate carbonates in the step of hydrogenation for liquefaction or effectively separating and removing such formed carbonates and the like in the step of hydrogenation for liquefaction and thereby increasing the liquefaction efficiency and the stability of continuous operation of the system.

BACKGROUND ART

Description of the Prior Art

As one of the coal liquefaction techniques, the so-called extraction-hydrogenation method is known in which coal dust is made into a slurry by mixing with a solvent and the solvent-extractibles alone are hydrogenated for liquefaction. However, some coal species contain fairly great amounts of moisture and in particular the brown coal moisture content may reach 60%. It is therefore uneconomical from the viewpoint of heat efficiency to subject such coal species to liquefaction treatment as they are, and accordingly it is necessary to conduct preliminary dehydration treatment prior to coal feeding to the liquefaction step. Conventionally, the moisture content is reduced to about 10% by applying the so-called gaseous stream drying technique. However, this technique is disadvantageous in (1) that a very large amount of energy is required for the heating of the gaseous stream, (2) that an oxide film is formed on the surface of brown coal particles, whereby the progress of the hydrogenation reaction is inhibited, and (3) that overheating may lead to the decomposition of volatile components in the coal material, which in turn results in a decreased liquefaction yield. The present applicant has previously established a steam heat exchange technique comprising heating the coal material and thereby separating the moisture in the coal material as steam and utilizing this high-temperature steam in heating the coal material and has applied for a patent thereon (Japanese Patent Application Kokai No. 53(1978)-112802). The essence of the above technique lies in slurrying raw brown coal by mixing the coal with a solvent, passing the slurry through a heat exchanger for preheating, heating the slurry further to 100°-300° C. to cause a gas-liquid separation, and collecting the dehydrated slurry while circulating the steam separated to the above-mentioned heat exchanger where the steam is used as a heat source for the preheating of the starting slurry. This technique has thus removed the above-mentioned drawbacks all at once.

When the above technique is used, the moisture existent in brown coal can be removed in a very reasonable and economical manner. However, in the brown coal liquefaction treatment, there remains another problem to be solved promptly. The problem is that when a slurry, the main component of which is brown coal, is used in an extraction-hydrogenation process, a large amount of deposit forms in the preheater, reactor and/or slurry transportation pipeline and may make it impossible to continue operation or may sometimes result in an detrimental scaling accidents and, hence in heavy damages. Under these circumstances, it becomes necessary to prevent deposits and scales. As a result of investigating nature of the deposits, it can now be said with confidence that metal carbonates play an important role thereof. Brown coal contains carbonate-forming metal components such as Ca and Mg (hereinafter such componets are referred to as Ca etc.). For instance, it has been reported that, in the case of Rhine brown coal (produced in Germany), 44 percent by weight of its ash content was composed of CaO. Moreover, a characteristic feature of the structure of brown coal is that it contains compounds with oxygen-containing substituent such as hydroxyl, carboxyl and carbonyl groups. It is furthermore thus a fact that these substituent groups are easily decomposed in the coal dissolution and/or hydrogenation/liquefaction reaction step to form $H_2O$, $CO_2$, CO and so on in the system. Among these, $H_2O$ directly amplifies the moisture content increase and leads to a reduced liquefaction efficiency through a decrease in the hydrogen partial pressure in the reaction step, while $CO_2$ and CO react with Ca etc. coexisting in the system to form carbonates which may cause formation of deposits or scales.

DISCLOSURE OF THE INVENTION

In view of the special circumstances encountered in the liquefaction of brown coal by hydrogenation, such as those mentioned above, it is very important from an economical viewpoint to overcome the two great difficulties described above (excessive moisture content and formation of precipitate or the like) simultaneously. The present invention, made with due regard to these circumstances, provides a method capable of conveniently achieving two great purposes, namely attaining a satisfactorily efficient dehydration in the pretreatment step and preventing carbonate formation in the hydrogenation/liquefaction step through the stabilization of Ca etc. at a stage as early as possible.

Another object of the invention is to prevent troubles in the reaction system by positively extracting such precipitate as mentioned above, particularly the formed carbonates and the like, as early as possible and thereby assuring a long-term stable operation of the brown coal liquefaction plant.

This invention subjects the starting slurry composed of raw brown coal and a solvent to a gas-liquid separation at an elevated temperature and increased pressure so as to effect moisture release in the form of steam, utilizing steam as a source of heat for elevating the temperature of the slurry, blowing the $CO_2$-containing gas coproduced by said gas-liquid separation and/or a $CO_2$-containing gas supplied from the outside the system into the starting thereby positively stabilizing Ca, etc, in brown coal in this step as fine carbonate particles. The time for removing the carbonate particles and the means for removing the same can be selected depending on the circumstances. Thus, the invention removes all the difficulties mentioned above by conducting the dehydration step and the carbonate formation/stabilization step as pretreatment steps prior to hydrogenation for liquefaction. The carbonates positively formed in such pretreatment step, even when fed to the hydrogenation/liquefaction step without separation, do not affect the SRC purification step since they are not re-dissolved in the liquid reaction mixture. They occur as very fine particles which are highly floatable. Accordingly, they cannot be deposited on the catalyst or vessel wall. There is not possibility of their piling up or forming scales due to grain growth.

Therefore, no blocking- or scaling-caused accidents do are expected to happen, and. continuous operation is possible under stable conditions. The above-mentioned formed carbonates are, in most cases, carried into the hydrogenation/liquefaction step without separation. In such cases, the high-concentration slurry containing the formed salts is drawn out from the reaction tower bottom and introduced into the solid-liquid separation unit. The high-solid-content slurry separated is further subjected to an ash-removing step, while the low-solid-content slurry is recycled to the reaction tower for hydrogenation. In this manner, the above formed salts can be removed in an efficient manner with an improved recovery of the liquid drawn out concomitantly with said formed salts, and the deactivation of the hydrogenation catalyst due to the formed salts can be inhibited, whereby the hydrogenation efficiency can be improved and the yield of SRC can be much increased.

BEST MODE FOR CARRYING OUT THE INVENTION

Figure 1:
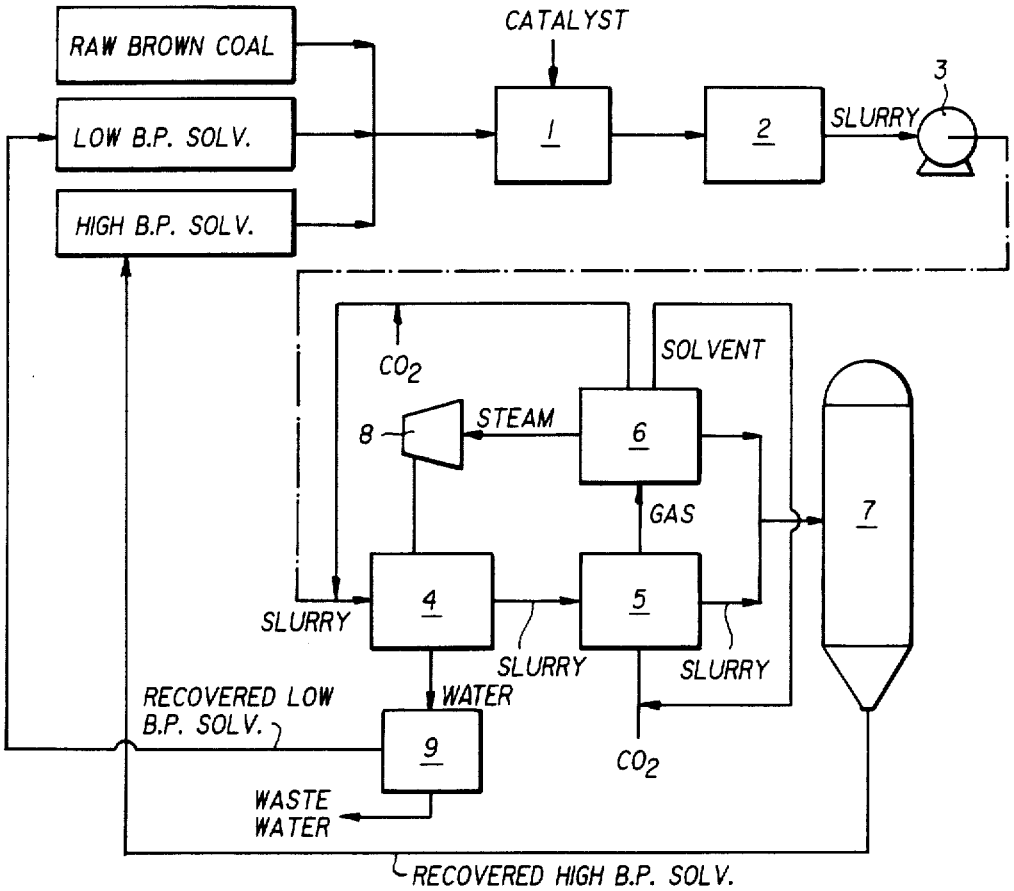
FIG. 1 is a flowchart illustrating an embodiment of the method of brown coal liquefaction treatment in accordance with the invention.

Referring to FIG. 1, there is shown a flowchart illustrating an embodiment of the method, in which embodiment the $CO_2$-containing gas (although such gas also contains CO and other gases, the gas is hereinafter referred to briefly as $CO_2$) produced in the system and/or $CO_2$ supplied from outside the system is blown into the slurry at the inlet to a heat exchanger 4 and/or in a gas-liquid separator 5. Raw brown coal, a low-boiling solvent and a high-boiling solvent are used as the starting materials and, if necessary after addition of a granular catalyst in a ball mill 1 provided as necessary, they are introduced into a slurry tank 2 and exposed to an adequate mixing action to give the starting slurry. The kinds and amounts of the solvents are not critical provided that the organic solvents used can provide an adequate viscosity throughout the whole process. The slurry is fed under pressure to the heat exchanger 4 by means of a pump 3. In the heat exchanger, the slurry is heated and moisture contained therein is evaporated. If necessary, the slurry is further introduced into an adequate heater so that additional and sufficient moisture evaporation can take place until the moisture content is reduced to a contemplated level (not more than about 10%). The heating temperature is generally 100°–400° C., preferably 110°350° C. The slurry is then fed, at a pressure which enables moisture to evaporate to a sufficient extent at said temperature, to a gas-liquid separator 5. The heat source in the exchanger 4 is steam fed from a pressurizing means to be mentioned hereinafter. Said steam, after heat exchange, is cooled and introduced into an oil-water separator 9, where the low-boiling solvent is recovered. The slurry to be fed to the gas-liquid separator 5 contains not only the above-mentioned steam but also minute particles of various carbonates and gaseous phase $CO_2$ since the reaction of $CO_2$ supplied from outside the system or from a $CO_2$ separator 6 with Ca etc. has already proceeded. Therefore, in the gas-liquid separator 5, steam and gaseous phase $CO_2$ are separated from the slurry and the precipitated carbonates, and the gaseous phase separated is fed to a $CO_2$ separator 6. In the $CO_2$ separator 6, gaseous $CO_2$ and steam are separated from each other, for example by $CO_2$ adsorption or by steam condensation and reheating, and respectively recycled in the manner mentioned hereinbefore. If the recycling steam contains uncondensable gases such as $CO_2$ or CO, the efficiency of heat transfer within the heat exchanger 4, hence the thermal efficiency, will be decreased. It is therefore recommendable to remove $CO_2$, CO and the like as completely as possible. It is also recommendable to feed the steam purified in the $CO_2$ separator 6 to the heat exchanger 4 after pressurization by means of a pressurizing means 8 such as a booster and temperature raising corresponding to said pressurization. On the other hand, the slurry coming out of the gas-liquid separator 5 is combined with the solvent portion recovered in a small amount from the $CO_2$ separator 6 and fed to the hydrogenation step 7 and there subjected to hydrogenation/liquefaction reaction. It is desirable to recover the high-boiling solvent used for mixing with brown coal by distillation of the hydrogenation reaction product obtained from the hydrogenation step 7 and recycle the same. In this embodiment, out-of-system $CO_2$ or in-system $CO_2$ is supplied also to the gas-liquid separator 5, so that Ca etc. form as fine carbonate particles also in the gas-liquid separator 5, whereby the carbonate-forming metal component-stabilizing effect is further increased.

Figure 2:
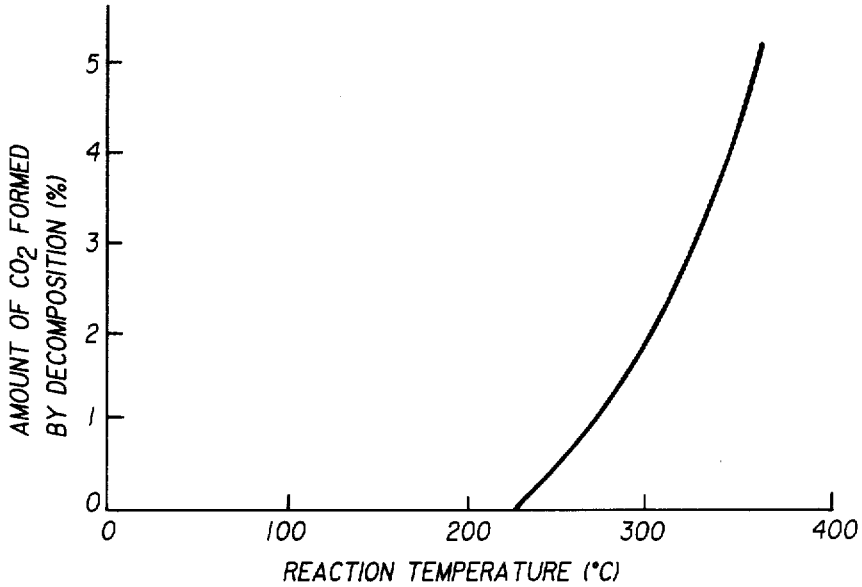
FIG. 2 is graphic representation of the relationship between the reaction temperature and the amount of $CO_2$ formed by decomposition when Morwell brown coal is used as a brown coal species.

The conditions under which the heat exchanger 4 and the gas-liquid separator 5 are to be operated have briefly been described above. A supplementary explanation is now given. Referring to FIG. 2, there is shown graphically the relationship between the temperature and the amount of $CO_2$ formed by decomposition as recognized by using Morwell brown coal (moisture 12%, ash 4%, solvent/coal ratio = 3.0). It is seen that $CO_2$ is formed at temperatures exceeding 200° C. in an amount rapidly increasing with the increase in temperature. At this stage, there exists a sufficient amount of water from the dehydration step.

In view of the above, it is advisable to select the operation conditions with due regard to the following. As explained above, when the temperature in the heat exchanger 4 is 250° C., the formation of $CO_2$ by decomposition seems to be very slight, as indicated in FIG. 2, and therefore supplementary feeding of $CO_2$ from outside the system, as shown in FIG. 1, becomes necessary. To cover the $CO_2$ requirement with in-system $CO_2$ alone, it is necessary to raise the temperature to about 400° C. Thus, a temperature at which Ca etc. can be separated from the structure of brown coal but at which brown coal is not dissolved very much, or a temperature not exceeding the boiling points of the solvents for slurry formation is a desirable temperature. The pressure is desirably selected at a level not exceeding ten-odd atmospheres in consideration of the efficiency of recompression work in steam recovery. It is of course possible that the $CO_2$ to be supplied to the gas-liquid separator be introduced 100 percent from outside the system. In this case, the $CO_2$ separator 6 is not necessary.

Figure 3:
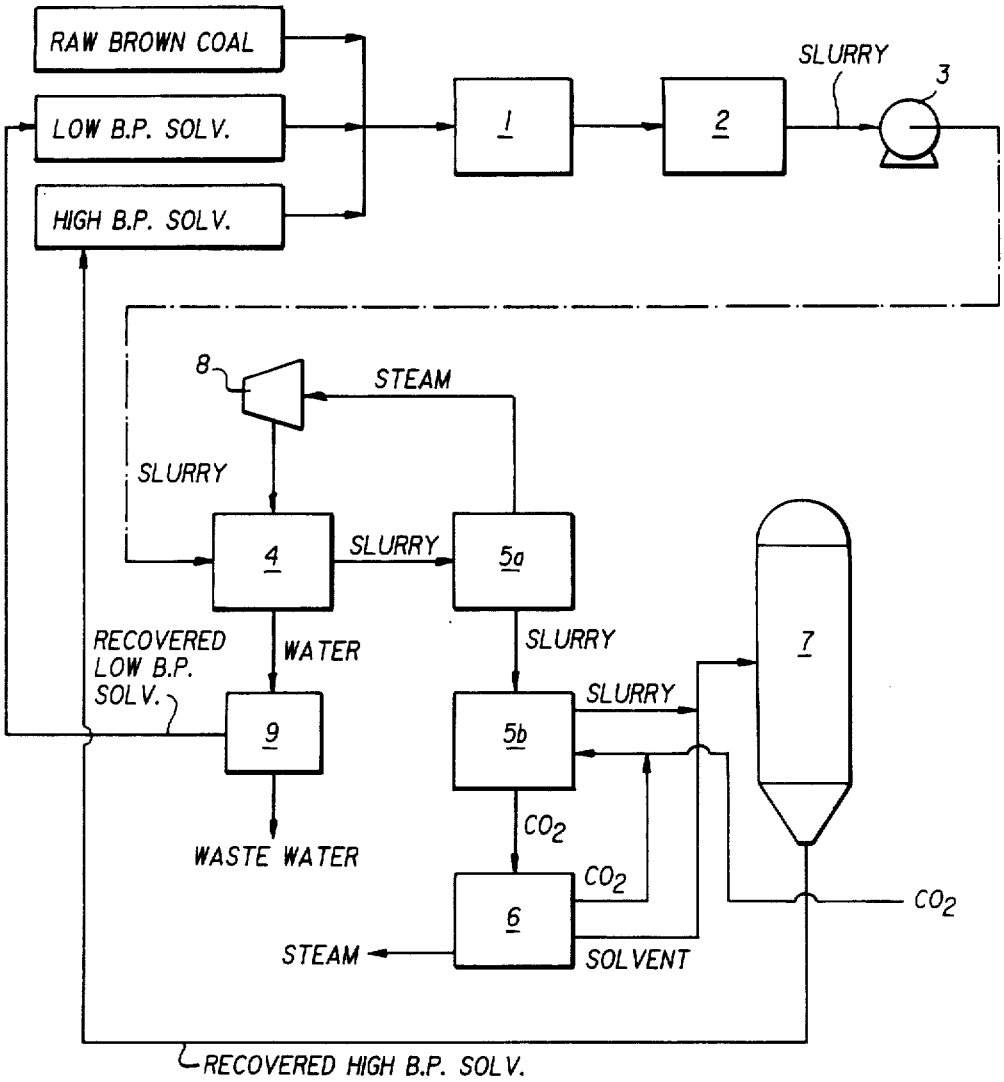
FIG. 3 is a flowchart illustrating another embodiment of the method of brown coal liquefaction treatment in accordance with the invention.

FIG. 3 is an exemplary flowchart for further increasing the thermal efficiency of the heat exchanger 4.

The gas-liquid separator is divided into two stages 5*a* and 5*b*. In the former 5*a*, steam alone is separated, while the main object of the latter 5*b* is carbonate formation. In the embodiment illustrated in FIG. 1, the $CO_2$ separator 6 is provided for separating steam and $CO_2$ from each other but complete separation of both is difficult. As a result, the steam to be fed to the heat exchanger 4 contains a certain amount of $CO_2$, and, for that reason, the thermal efficiency of the heat exchanger 4 is not always satisfactory. Therefore, in the embodiment shown in FIG. 3, the gas-liquid separator 5*a* is operated at a considerably low pressure so as to inhibit the formation of $CO_2$ due to decomposition and at the same time the supply of $CO_2$ to the preceding step is shut off. Therefore, the steam separated in the gas-liquid separator 5*a* does not contain $CO_2$, so that its passage through a $CO_2$ separator is not required. Pressurization is the only requirement before feeding the steam to the heat exchanger 4. The second gas-liquid separator 5*b* is heated to the thermal decomposition (pyrolysis) temperature with a high-temperature heat medium, while maintaining the pressure at 100 atmospheres or below, preferably at tens of atmospheres, so as to suppress the amount of evaporation of the solvent, and a small portion of steam is condensed and separated in the $CO_2$ separator 6 by condensation, for instance, and the condensate is drained by an appropriate means. Since the $CO_2$ formed by thermal decomposition in the gas-liquid separator 5*b* directly reacts with Ca etc. to form carbonates, the above-mentioned $CO_2$ is unreacted $CO_2$ and can be recycled to the gas-liquid separator 5*b*. Therefore, the out-of-system $CO_2$-supplying line tentatively shown in FIG. 3 is in most cases unnecessary in the practical operation of the plant.

Figure 4:
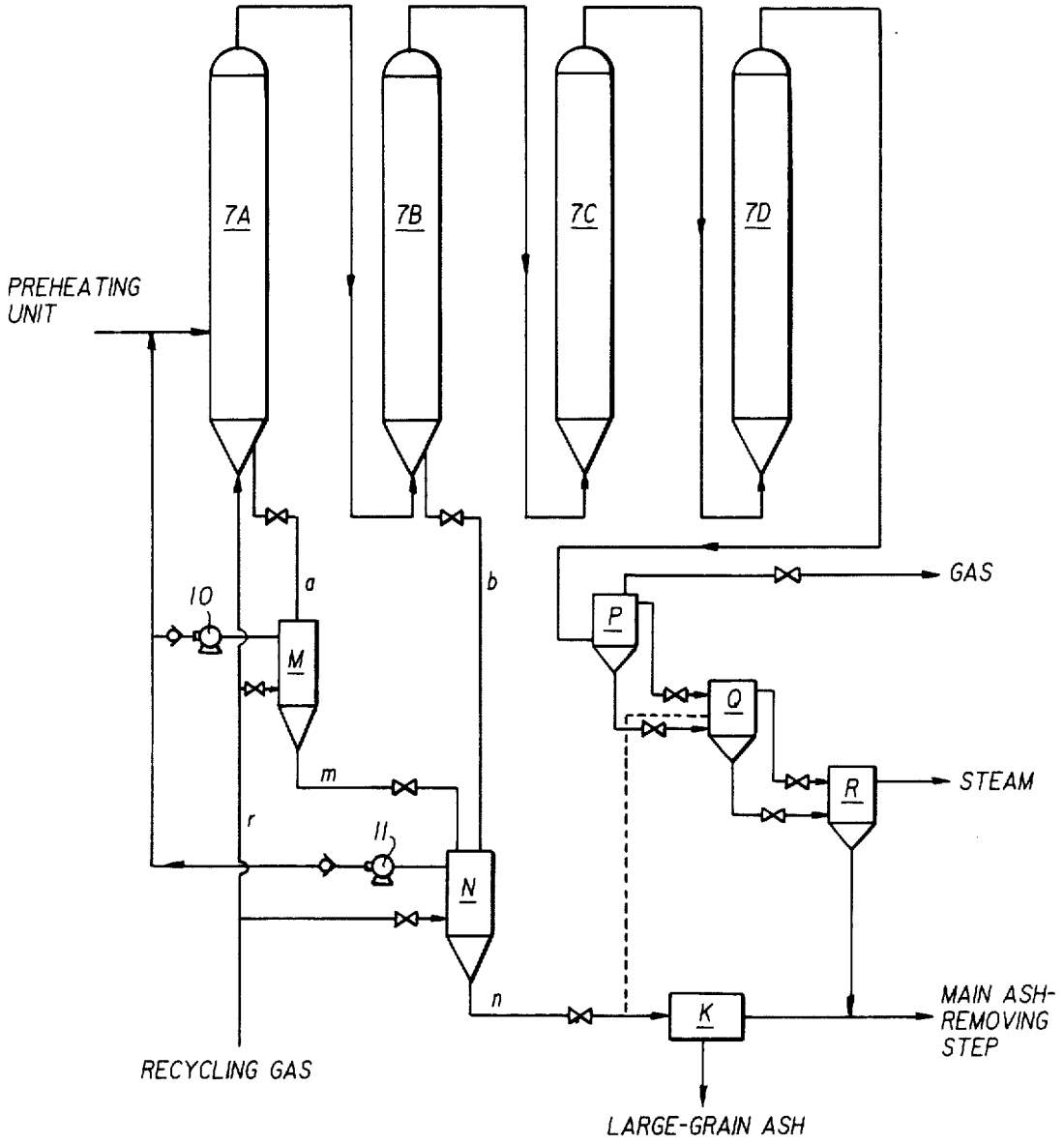
FIG. 4 is a flowchart illustrating an exemplary hydrogenation/liquefaction step for the slurry after the dehydration and carbonate precipitation steps.

Referring now to FIG. 4, which illustrates the step to be carried out in the hydrogenation/liquefaction reactor tower system, 7A, 7B, 7C and 7D are the first, second, third and fourth reactor towers, respectively. The high-temperature slurry treated in the steps shown in FIG. 1 or FIG. 3 referred to in the above is fed through a preheating unit together with hydrogen gas and first enters the first reactor tower 7A. The gas separated within the system is introduced as the recycling gas into the bottom of the first reactor tower 7A. The number of the reactor towers is 4 in the illustrated case, although the method of the invention is applicable also to cases where 1 to 3 or 5 or more towers are involved without any inconvenience.

In the plant portion illustrated in the figure, the first reactor tower 7A and the second reactor tower 7B each is provided at the bottom thereof with a high-concentration slurry-extracting line a, b. The high-concentration slurry containing a large amount of carbonates formed in the manner mentioned above and carbonates newly precipitated in each reactor tower is introduced into a high-pressure settling vessel M, N. In each vessel, these carbonates are allowed to settle. The carbonate precipitate in the vessel M is further drawn out through an extraction line m and combined with the contents of the vessel N. The precipitate-containing liquid in the vessel N is drawn out through a line n and fed to a preliminary ash-removing means K, where a certain portion ash fraction is removed. The remaining portion is further fed to a main ash-removing step.

On the other hand, the high-pressure settling vessels M and N are each connected with a recycling gas-returning line r and adjusted in an atmosphere of hydrogen under pressure. Since the high-concentration slurry introduced in each vessel M, N contains a large proportion of the solvents with coal extracts dissolved therein, feeding of said slurry as it is to the ash-removing step, which means subjecting those brown coal components that have reacted to an unsatisfactory extent to after-treatment, is very uneconomical. Therefore, in the high-pressure settling vessels M and N, solid separation as a result of settling is allowed to proceed so that the slurry can be separated into a high-solid-content slurry and a low-solid-content slurry (supernatant layer). Each high-solid-content slurry is drawn out through the line m, n, as mentioned above, while each low-solid-content slurry is drawn out by means of a pump 10, 11 and either combined with feed line stream from the preheating unit or returned directly to the first reactor tower 7A for hydrogenation. Since, in this manner, the solid matter-rich slurry portion out of the high-concentration slurry drawn out from the first reactor 7A is fed, after preliminary ash-removal and ash removal proper, to a treatment line, whereas the slurry portion poor in solid matter is returned to the first reactor tower 7A and subjected there again to hydrogenation, the solvent extracts are very rarely allowed to pass unreacted. Furthermore, while the slurry is recycled in this manner, the concentration of brown coal hydrogenation products in the liquid phase of the high-solid-content slurry is increased to a certain level. Therefore, it is also possible to design to increase the SRC recovery rate by introducing part of the high-solid-content slurry in the line n into a settling vessel Q (or P or R), as indicated by the broken line in FIG. 4, for combination thereof with the hydrogenated liquid reaction mixture and feeding the whole liquid mixture to a final distillation step.

Since the formed carbonates and the like are positively drawn out from the reactor tower 7A (in the illustrated example, also from the reactor tower 7B) in the manner mentioned above, said carbonates rarely deposit or settle in the reactor towers 7A to 7D or in the pipings connecting these with each other and cause no particular troubles during continuous operation of the plant. However, it is not desirable to feed the reaction mixture which has passed through the reactor towers 7A to 7D as it is to a gaseous component reservoir or to a distillation apparatus since it still contains a large proportion of insoluble matters such as the carbonates mentioned above. Therefore, as shown in FIG. 4, there are provided high-pressure settling vessels P, Q and R, and the reaction mixture coming out of the reactor tower 7D is introduced in sequence into the settling vessels P-R. In this case, the amount of the slurry transferred bottom-to-bottom from the vessel P to the vessel Q or from the vessel Q to the vessel R is small because the insoluble matter content is small, and the majority of the reaction mixture, the supernatant, is fed to the distillation step. The minor portion of the high-solid-content slurry in the bottom is combined with the previously-mentioned high-solid-content slurry after completed preliminary ash removal and fed to the step of ash removal proper.

The drawing out of the high-concentration slurry from the reactor tower or towers means in an aspect positive removal of insoluble inorganic components originally contained in brown coal. Therefore, when the reactor tower unit is divided into a plurality of stages, then it is recommendable to design the plant arrangement with a view to conduct the above-mentioned drawing out at a site as early as possible and remove the still remaining portions at the second and/or third reactor tower. Since the reactor tower contents are stirred vigorously by hydrogen gas, the high-concentration slurry drawn out from the bottom contains not only the formed carbonates and the like, as mentioned above, but also a considerable amount of fine catalyst grains. Therefore, to separate such fine catalyst grains still retaining catalytic activity from those catalyst grains which have grown as a result of coating with carbonates and the like and have lost the catalytic activity and recycle the fine catalyst grains in the manner mentioned above becomes much more important. When such fine grains are recycled, not only the catalyst grains but also fine grains of insoluble brown coal components are recycled, so that the total grain surface in the reaction system becomes greater. As a result, the carbonate precipitation can proceed in an efficient manner, which contributes to increasing the effect of preventing scaling in the reactor towers or in the piping. All the particles or grains flowing through the reaction system are fine-sized and, when they are catalyst grains, the catalytic activity can effectively be retained and the degree of hydrogenation can be increased. In the conventional SRC processes, the final product SRC is also subjected to an ash-removing step so as to completely remove insoluble matter. When, in that case, the ash content removable in said step is high, the loss of SRC is thought to increase proportionally. On the contrary, when the high-solid-content slurry (sludge) is drawn out positively and preliminary ash removal is performed in accordance with the present invention, the ash content in the distilled SRC becomes reduced. Even when the ash removal proper is performed with the joining liquid stream from the preliminary ash removal step, the amount of removable ash is small itself and accordingly it is possible to reduce the loss of SRC.

INDUSTRIAL APPLICABILITY

The present invention, which has the above constitution and according to which moisture and Ca etc. contained in brown coal are treated almost without failure prior to the hydrogenation/liquefaction reaction with the moisture being released out of the system and the Ca etc. being stabilized in the form of fine carbonates, has dissipated the fear of blocking-caused accidents. Moreover, the formed and/or precipitated carbonates can be removed efficiently in the hydrogenation/liquefaction step and the liquid portion drawn out with the formed salts can be recovered efficiently for recycling. Therefore, troubles in the processing system as caused by accumulation of adhesion of salts become rare, stable long-term continuous operation becomes possible, and the yield of SRC becomes improved. Particularly in a system where a catalyst is used, the deactivation of the catalyst is inhibited as far as possible and the catalyst is recycled in an efficient manner, so that the invention can contribute to the improvement of hydrogenation efficiency.

We claim:

1. A process for the liquefaction of brown coal, which comprises:

(a) increasing the temperature of a brown coal slurry in a solvent to 250° to 400° C. under pressure;

(b) dewatering said brown coal slurry as the temperature of the coal slurry increases in step (a) by the application of steam which is obtained from a gas-liquid phase separation step;

(c) preheating said dewatered brown coal slurry and hydrogen gas in a preheater;

(d) feeding the heated slurry and hydrogen to at least four hydrogenation reactor towers connected in series where hydrogenation of the brown coal is conducted and in which high concentration metal salt-containing slurries form;

(e) withdrawing said salt-containing slurries from the bases of at least first two hydrogenation reactor towers and passing said slurries to at least two high pressure settling vessels connected in series in which a high solids content slurry and a low solids content slurry, as a supernatant, form;

(f) recovering said low solids contents slurry and recycling this slurry to the first of said hydrogenation reactor towers;

(g) withdrawing all of the reaction mixture exiting the last of the hydrogenation reaction towers and passing the withdrawn reaction material to the first of a plurality of settling vessels connected in series in which the reaction mixture separates into relatively small amounts of high solids content slurry and supernatant material;

(h) distilling said supernatant material to recover liquefied coal material; and (i) deashing the high solids content slurry withdrawn from said settling vessels.

2. The process of claim 1, wherein said salt-containing slurries are withdrawn from the bases of both the first and second hydrogenation reactor towers.

3. The process of claim 1, wherein, subsequent to hydrogenation of the coal in the hydrogenation reactor towers, the hydrogenation reaction product is distilled to remove the high-boiling solvent originally present in the slurry, and then the separated high-boiling solvent is recycled to the first step of the process in order to provide solvent for coal slurry formation.

* * * * *

UNITED STATES PATENT AND TRADEMARK OFFICE

CERTIFICATE OF CORRECTION

PATENT NO. : 4,714,543

DATED : December 22, 1987

INVENTOR(S) : Tetsuo Matsumura et al.

It is certified that error appears in the above-identified patent and that said Letters Patent is hereby corrected as shown below:

Title page:

-- Priority Data is omitted from Letters Patent.
Should read as follows:

Feb. 22, 1982 [JP] Japan.....57-27981

Feb. 22, 1982 [JP] Japan.....57-27982--

Signed and Sealed this

Fourteenth Day of June, 1988

*Attest:*

DONALD J. QUIGG

*Attesting Officer*

*Commissioner of Patents and Trademarks*